US008776287B1

(12) United States Patent
Jarrett

(10) Patent No.: US 8,776,287 B1
(45) Date of Patent: Jul. 15, 2014

(54) BOTTOM BED SHEET WITH CELL PHONE POCKETS

(71) Applicant: Elise M. Jarrett, Papillion, NE (US)

(72) Inventor: Elise M. Jarrett, Papillion, NE (US)

( * ) Notice: Subject to any disclaimer, the term of this patent is extended or adjusted under 35 U.S.C. 154(b) by 0 days.

(21) Appl. No.: 14/195,281

(22) Filed: Mar. 3, 2014

(51) Int. Cl.
*A47G 9/00* (2006.01)

(52) U.S. Cl.
USPC ..... 5/485; 5/486; 5/495; 5/482

(58) Field of Classification Search
USPC ..... 5/417, 418, 419, 420, 482, 485, 486, 5/495, 497, 658
See application file for complete search history.

(56) References Cited

U.S. PATENT DOCUMENTS

| | | | | |
|---|---|---|---|---|
| 7,621,005 | B1 * | 11/2009 | Harvey | 5/419 |
| 2007/0157384 | A1 * | 7/2007 | Alexander | 5/494 |
| 2008/0028518 | A1 * | 2/2008 | Miotke et al. | 5/482 |
| 2008/0127414 | A1 * | 6/2008 | Allen | 5/417 |
| 2008/0235848 | A1 * | 10/2008 | Wilder et al. | 2/69.5 |
| 2010/0162486 | A1 * | 7/2010 | Joyce | 5/485 |
| 2013/0125308 | A1 * | 5/2013 | Fittin et al. | 5/485 |
| 2014/0000036 | A1 * | 1/2014 | Cohen | 5/639 |

* cited by examiner

*Primary Examiner* — Robert G Santos
*Assistant Examiner* — David E Sosnowski
(74) *Attorney, Agent, or Firm* — Dennis L. Thomte; Thomte Patent Law Office LLC

(57) ABSTRACT

A bottom bed sheet for a mattress is provided wherein the sheet has cell phone pockets formed therein. The bottom bed sheet may be positioned with respect to the mattress whereby a cell phone pocket is positioned at the upper right side of the sheet or positioned at the upper left side of the sheet.

10 Claims, 3 Drawing Sheets

BOTTOM BED SHEET WITH CELL PHONE POCKETS

BACKGROUND OF THE INVENTION

1. Field of the Invention

This invention relates to a bottom bed sheet and more particularly to a bottom bed sheet having a pair of cell phone pockets secured thereto. Even more particularly, the invention relates to a bottom bed sheet having cell phone pockets provided thereon in such a manner so that one of the cell phone pockets may be positioned at the upper right side of the bed or at the upper left side of the bed. Even more particularly, this invention includes cell phone pockets wherein the cell phone therein may have its charging cord extending outwardly therefrom to a source of electrical power.

2. Description of the Related Art

Many bed sheets or coverings have been previously provided which include pockets on the upper side of the bed sheet or covering or on the sides of the bed sheet or covering. To the best of Applicant's knowledge, no one has previously provided a bottom bed sheet having cell phone pockets which may be positioned at either the right side of the bed or the left side of the bed by turning the bed sheet 180 degrees with respect to the associated mattress.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A bottom bed sheet is disclosed comprising a fabric sheet adapted to be positioned on a mattress having a head end, a foot end, a right side and a left side, such that the sheet has a first end portion with first and second ends, a second end portion with first and second ends, a first side portion, having first and second ends, extending between the first end of the first end portion of the sheet and the first end of the second end portion of the sheet, and a second side portion, having first and second ends, extending between the second end of the first end portion of the sheet and the second end of the second end portion of the sheet. The sheet has an inner surface and an outer surface.

The sheet is selectively movable between first and second positions with respect to the mattress. The sheet, when in its first position, having the first end thereof at the top head end of the mattress and has the second end thereof positioned at the foot end of the mattress. The sheet, when in its second position, has the first end thereof at the foot end of the mattress and has the second end thereof at the head end of the mattress.

A first pocket flap is secured to the sheet, when the sheet is in its first position, so as to be positioned inwardly of the first end portion of the sheet and inwardly of the first end of the first side portion of the sheet. A second pocket flap is secured to the sheet, when the sheet is in its first position, so as to be positioned inwardly of the second end portion of the sheet and inwardly of the second end of the first side portion of the sheet. The first pocket flap, when the sheet is in its first position, has an upper edge with first and second ends, a lower edge with first and second ends, a first side edge extending between the first end of the upper edge and the first end of the lower edge and a second side edge extending between the second end of the upper edge and the second end of the lower edge. The upper edge, first side edge and second side edge of the first pocket flap are secured to the sheet to form a cell phone pocket between the first pocket flap and the sheet. An opening is provided in the upper edge of the first pocket flap to permit a phone charging cord to extend therethrough.

A second pocket flap is secured to the sheet, when the sheet is in its first position, so as to be positioned inwardly of the second end portion of the sheet and inwardly of the second end of the first side portion of the sheet. The second pocket flap, when the sheet is in its first position, has an upper edge with first and second ends, a lower edge with first and second ends, a first side edge extending between the first end of the upper edge and the first end of the lower edge, and a second side edge extending between the second end of the upper edge and the second end of the lower edge. The lower edge, first side edge and the second side edge of the second pocket flap are secured to the sheet to form a cell phone pocket between the second pocket flap and the sheet. An opening is positioned in the upper edge of the second pocket flap to permit a phone charging cord to extend therethrough.

The cell phone pocket of the first pocket flap is positioned inwardly of the head end of the mattress and is positioned at the right side of the mattress when the sheet is in its first position. The cell phone pocket of the second pocket flap is positioned inwardly of the right side of the mattress and positioned inwardly of the foot end of the mattress when the sheet is in its first position and is normally inaccessible.

The first pocket flap is positioned inwardly of the foot end of the mattress and inwardly of the left side of the mattress when the sheet is in its second position and is inaccessible in normal use. The second pocket flap is positioned inwardly of the head end of the mattress and inwardly of the left side of the mattress when the sheet is in its second position.

The sheet of this invention enables the cell phone pocket to be provided at either the right side of a bed or the left side of a bed by simply rotating or turning the bed sheet 180 degrees between first and second positions.

It is therefore a principal object to provide an improved bottom bed sheet.

A further object of the invention is to provide a bottom bed sheet wherein a cell phone pocket may be positioned at the right side of a bed or at the left side of a bed by moving the sheet 180 degrees with respect to the mattress.

A further object of the invention is to provide a bottom bed sheet of the type described including cell phone pockets which have an opening formed therein through which a phone charging cord may be extended.

A further object of the invention is to provide a bottom bed sheet which is easily retrofitted onto an existing bottom sheet.

A further object of the invention is to provide a bottom bed sheet which may be a fitted sheet or any other style of sheet.

A further object of the invention is to provide a bottom bed sheet which is suitable for use with a twin bed, twin XL, full size bed, queen size bed, king size bed or other sizes of beds.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
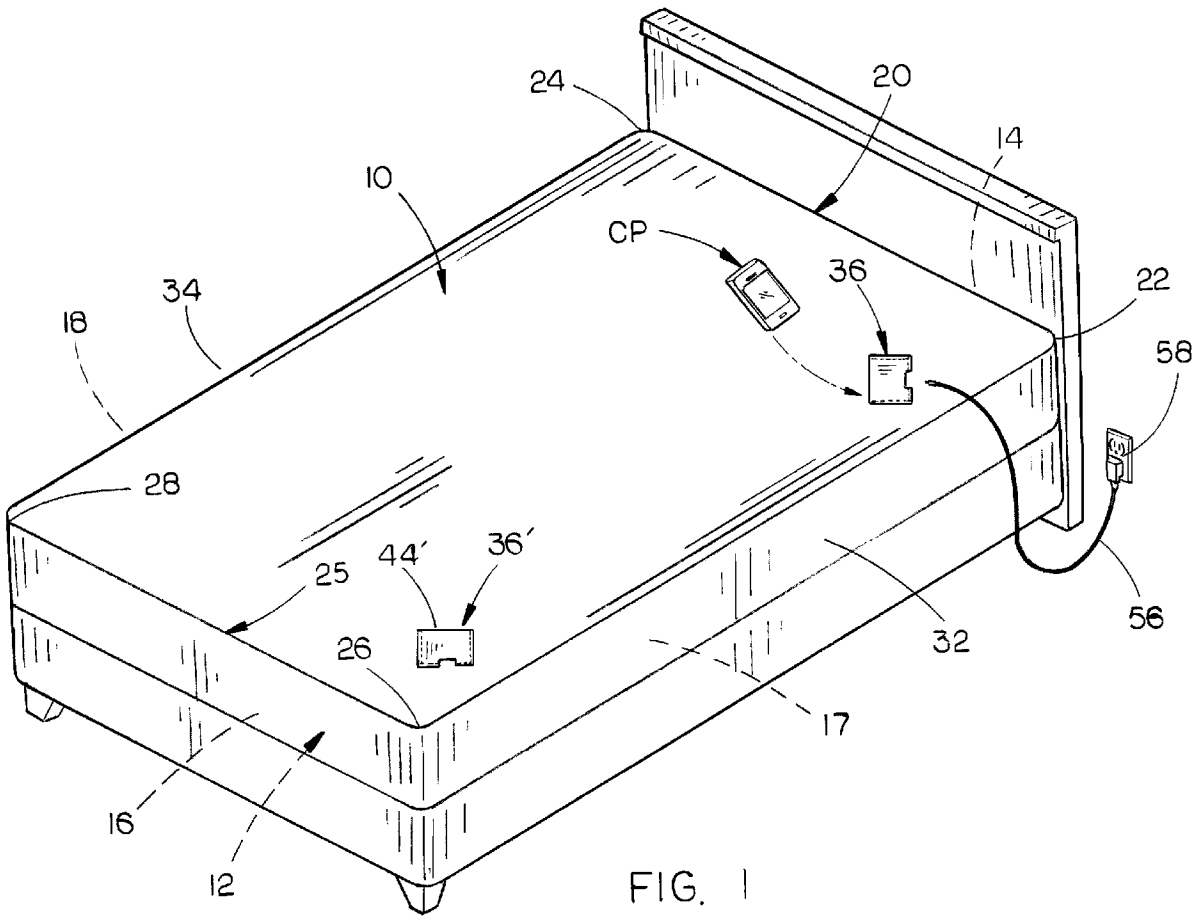
FIG. 1 is a perspective view of the bottom sheet of this invention secured to a mattress in a first position.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The bottom sheet of this invention is referred to by the reference numeral 10. Bottom sheet 10 may be sized to be a twin bed sheet, a twin XL, a three-quarter bed sheet, a full-size bed sheet, a queen-size bed sheet, king-size bed sheet or other sizes of bed sheets. The bottom sheet 10 may be a conventional sheet or a fitted contour sheet. The bottom sheet 10 is designed to be placed or secured to a mattress 12 having a head end 14, a foot end 16, a right side 17 and a left side 18.

Figure 2:
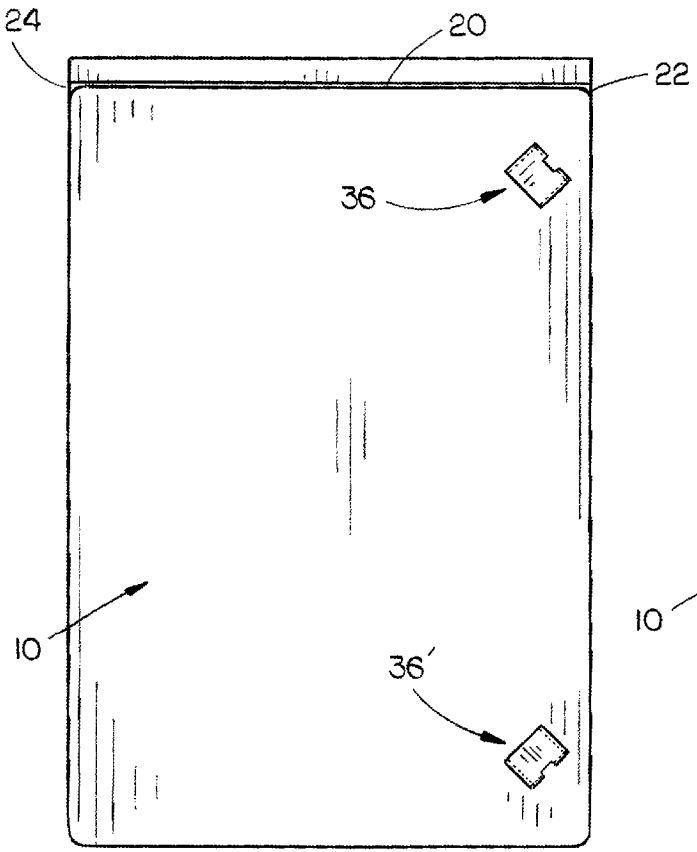
FIG. 2 is a top view of the bottom sheet of this invention secured to a mattress in the first position.
Figure 4:
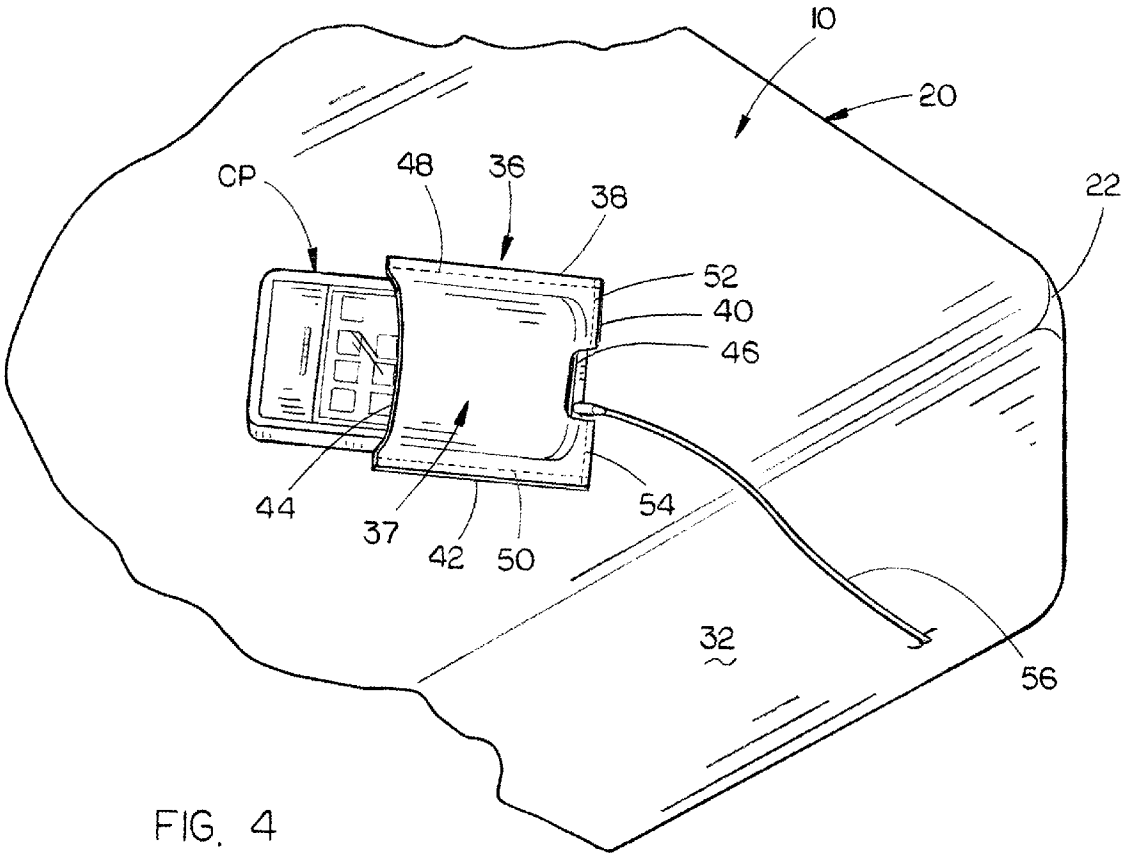
FIG. 4 is a partial perspective view of the bottom sheet of this invention which illustrates the manner in which a cell phone is positioned in a pocket flap.

Bottom sheet 10 is comprised of a fabric sheet configured to be secured to or placed upon the mattress 10 in a first position such as shown in FIGS. 1, 2 and 4. In the first position, bottom sheet 10 has a first end portion 20 with a first end 22 and a second end 24. In the first position, sheet 10 has a second end portion 25 with a first end 26 and a second end 28. Sheet 10 also has a first side 32 and a second side 34.

In the first position of FIGS. 1, 2 and 4, sheet 10 has a first cell phone pocket 36 secured to the upper surface inwardly of the second end 22 of first end portion 20 and inwardly of head end 14 as seen in FIGS. 1, 2 and 4. As will be discussed hereinafter, pocket 36 is designed to have a cell phone CP, selectively removably positioned thereon. Pocket 36 is comprised of a flexible pocket flap 37 having edges 38, 40, 42 and 44. Edge 40 of pocket flap 37 has an opening 46 formed therein. Edge 38 of pocket flap 37 is stitched to sheet 10 at 48. Edge 42 of pocket flap 37 is stitched to sheet 10 at 50. Edge 40 of pocket flap 37 is stitched to sheet 10 at 52 and 54 at opposite ends of opening 46. Edge 44 is not stitched to sheet 10 so that a pocket is formed to enable the cell phone CP to be inserted into the pocket 36.

It is preferred that the pocket flap 37 be angularly disposed with respect to the second end portion 20 and second end 22 to permit easy access to the cell phone CP. When the cell phone CP is inserted into pocket 36, the charging cord 56 may extend outwardly from the pocket 36 to an outlet 58.

A second cell phone pocket 36' is secured to the sheet 10 as seen in FIGS. 1 and 2. As seen in FIG. 1, when the sheet 10 is in the first position, the edge 44' faces upwardly and inwardly. Thus, when a person sleeping upon the right side of the mattress desires to have his/her cell phone close to the right side of the bed, pocket 36 will be used. In the first position of FIGS. 1, 2 and 4, the pocket 36' will not be used.

Figure 3:
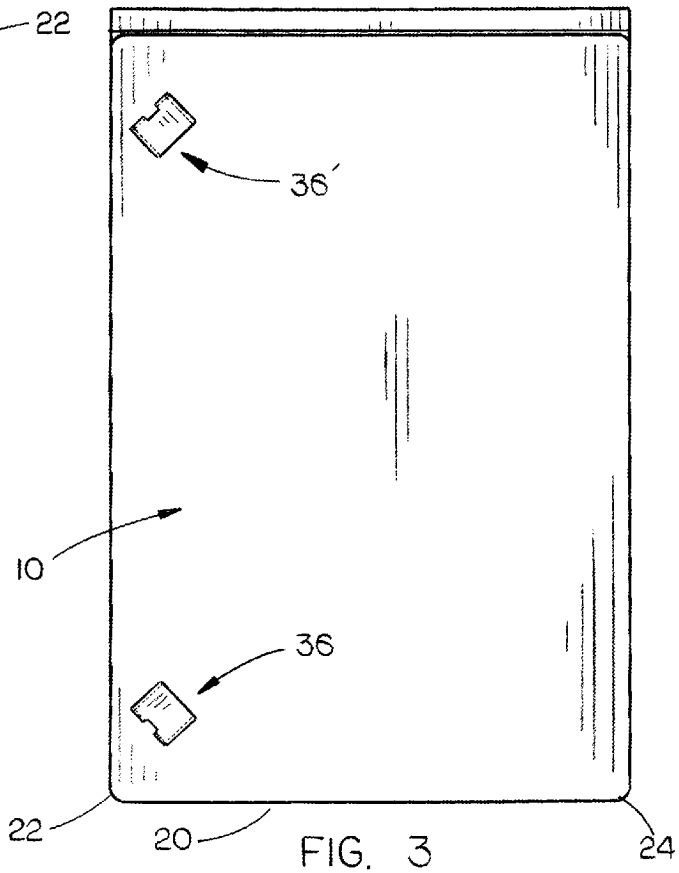
FIG. 3 is a top view of the bottom sheet of this invention secured to a mattress in a second position.

If it is desired to sleep on the left side of the mattress 12 or to have a cell phone pocket at the left side of the mattress 12, the sheet 10 is rotated or turned 180 degrees from the position of FIG. 2 to the position of FIG. 3 so that the pocket 36' is at the upper left portion of the sheet 10. In that position, a cell phone may be inserted into pocket 36'. In that position, pocket 36 will not be used.

Thus it can be seen that a novel bottom sheet 10 has been provided wherein a cell phone pocket may be selectively positioned at the upper right side of the bed or at the upper left side of the bed. Thus, the bottom sheet of this invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A bottom bed sheet, comprising:

a fabric sheet adapted to be positioned on a mattress with the mattress having a head end, a foot end, a right side and a left side, such that the sheet has a first end portion with first and second ends, a second end portion with first and second ends, a first side portion, having first and second ends, extending between the first end of the first end portion of the sheet and the first end of the second end portion of the sheet, and a second side portion, having first and second ends, extending between the second end of the first end portion of the sheet and the second end of the second end portion of the sheet;

said sheet having an inner surface and an outer surface;

said sheet being selectively movable between first and second positions with respect to the mattress;

said sheet, when in said first position, having said first end portion thereof at the head end of the mattress and having said second end portion thereof at the foot end of the mattress;

said sheet, when in said second position, having said first end portion thereof at the foot end of the mattress and having said second end portion thereof at the head end of the mattress;

a first pocket flap secured to said sheet, when said sheet is in said first position, so as to be positioned inwardly of said first end portion of said sheet and inwardly of said first end of said first side portion of said sheet;

a second pocket flap secured to said sheet, when said sheet is in said first position, so as to be positioned inwardly of said second end portion of said sheet and inwardly of said second end of first side portion of said sheet;

said first pocket flap, when said sheet is in said first position, having an upper edge with first and second ends, a lower edge with first and second ends, a first side edge extending between said first end of said upper edge and said first end of said lower edge, and a second side edge extending between said second end of said upper edge and said second end of said lower edge;

said upper edge, said first side edge and said second side edge of said first pocket flap being secured to said sheet to form a cell phone pocket between said first pocket flap and said sheet;

a second pocket flap secured to said sheet, when said sheet is in said first position, so as to be positioned inwardly of said second end portion of said sheet and inwardly of said second end of first side portion of said sheet;

said second pocket flap, when said sheet is in said first position, having an upper edge with first and second ends, a lower edge with first and second ends, a first side edge extending between said first end of said upper edge and said first end of said lower edge, and a second side edge extending between said second end of said upper edge and said second end of said lower edge;

said lower edge, said first side edge and said second side edge of said second pocket flap being secured to said sheet to form a cell phone pocket between said second pocket flap and said sheet;

said first pocket flap being positioned inwardly of the head end of the mattress and being positioned at the right side of the mattress when said sheet is in said first position;

said second pocket flap being positioned inwardly of said right side of the mattress and positioned inwardly of the foot end of the mattress when said sheet is in said first position and being inaccessible in normal use;

said first pocket flap being positioned inwardly of the foot end of the mattress and inwardly of the left side of the mattress when said sheet is in said second position and being inaccessible in normal use;

said second pocket flap being positioned inwardly of the head end of the mattress and inwardly of the left side of the mattress when said sheet is in said second position;

wherein said upper edge of said first pocket flap has an opening formed therein to permit a cell phone charging cord to extend therefrom when said sheet is in said first position, the length of said opening of said first pocket flap being significantly less than the length of the lower edge of said first pocket flap; and wherein said lower edge of said second pocket flap has an opening formed therein to permit a cell phone charging cord to extend therethrough when said sheet is in said second position, the length of said opening of said second pocket flap being significantly less than the length of the upper edge of said second pocket flap.

2. The bottom bed sheet of claim 1 wherein said upper edge of said first pocket flap is angularly disposed with respect to said first end portion of said sheet.

3. The bottom bed sheet of claim 1 wherein said lower edge of said second pocket flap is angularly disposed with respect to said second end portion of said sheet.

4. The bottom bed sheet of claim 1 wherein said sheet is a fitted sheet.

5. The bottom bed sheet of claim 1 wherein said sheet is a twin size sheet.

6. The bottom bed sheet of claim 1 wherein said sheet is a twin XL size sheet.

7. The bottom bed sheet of claim 1 wherein said sheet is a full size sheet.

8. The bottom bed sheet of claim 1 wherein said sheet is a queen size sheet.

9. The bottom bed sheet of claim 1 wherein said sheet is a king size sheet.

10. The bottom bed sheet of claim 1 wherein said first and second pocket flaps are secured to said sheet by stitching.

* * * * *